US005346299A

United States Patent [19]

Werkmeister et al.

[11] Patent Number: 5,346,299

[45] Date of Patent: Sep. 13, 1994

[54] REFRIGERATOR DOOR MODULE MOUNTING ASSEMBLY

[75] Inventors: Robert L. Werkmeister, Shepherdsville; Michael J. McCauley, Coxs Creek, both of Ky.

[73] Assignee: General Electric Company, Louisville, Ky.

[21] Appl. No.: 92,040

[22] Filed: Jul. 15, 1993

[51] Int. Cl.[5] ..... A47B 96/16

[52] U.S. Cl. ..... 312/405.1; 312/408

[58] Field of Search ..... 312/401, 404, 405.1, 312/408, 322

[56] References Cited

U.S. PATENT DOCUMENTS 2,970,873 2/1961 Johnson ..... 312/405.1
3,056,640 10/1962 Squire .
4,867,512 9/1989 Wilkins et al. .
4,908,544 3/1990 Lau .

FOREIGN PATENT DOCUMENTS 0851667 10/1960 United Kingdom .

*Primary Examiner*—Edward K. Look
*Assistant Examiner*—Christopher Verdier
*Attorney, Agent, or Firm*—H. Neil Houser

[57] ABSTRACT

A storage module assembly for a refrigerator door having an outer shell and an inner liner, including a rear wall and side walls forming a recess in the liner. Each side walls has a series of vertically spaced apart ribs aligned with corresponding ribs on the facing side wall. The ribs extend outwardly from the liner bottom wall and each rib has a horizontal top wall with an upwardly projecting tab adjacent its distal end. The bottom wall of each rib has a short horizontal portion adjacent the liner rear wall and an upwardly inclined portion adjacent its distal end. The module includes side walls positionable adjacent the liner side walls. A pair of vertically spaced apart, generally horizontally extending rails project outwardly of each module side wall and each rail defines a downwardly opening recess. The module is assembled to the door by sliding the module rails between vertically adjacent pairs of liner ribs until tabs are aligned with recesses and then lowering the module to insert the tabs into the recesses.

11 Claims, 1 Drawing Sheet

REFRIGERATOR DOOR MODULE MOUNTING ASSEMBLY

BACKGROUND OF THE INVENTION

This invention relates to refrigerator door storage module assemblies and, more particularly, to such assemblies in which the modules are firmly retained in a fully supported position in the door recess while being easily inserted and removed.

Modern day refrigerators often include door mounted modules, such as bins, drawers, trays or shelves for example. They typically are used to store numerous items which are used frequently, particularly such frequently used items that are relatively small. In the past several years a number of schemes or assemblies have been introduced to provide greater flexibility by enabling the user to selectively mount different modules at numerous locations on the inner liner of the door, particularly on the fresh food compartment door. One such approach is shown and described in co-pending application Ser. No. 08/010,657, filed Jan. 28, 1993 for John A Sedovic et al, and assigned to General Electric Company, assignee of the present invention.

The present invention provides an improved door and module assembly which firmly retains a module in a fully supported position in a recess in the door liner while, at the same permitting easy insertion and removal of the module in any of a number of locations.

SUMMARY OF THE INVENTION

A refrigerator door storage module assembly includes a door having an outer shell and an inner liner, with the liner including side and rear walls defining a recess. A series of vertically spaced apart module supporting ribs project inward of each side wall in alignment with corresponding ribs on the other side wall. Each rib extends forward from the liner rear wall and includes top and bottom walls. The top walls are generally horizontal and include upwardly projecting tabs adjacent their forward ends. The bottom walls include horizontal sections adjacent the liner rear wall and upwardly inclined portions between the horizontal portions and the forward ends. At least one storage module includes side walls spaced apart to be positionable adjacent the liner side walls when the module is mounted in the recess in the liner. A pair of vertically spaced apart rails project outwardly of the module side walls and extend from adjacent the rear of the module toward the front of the module. Each rail defines a downwardly opening recess so that the module is assembled to the liner by inserting the module between the liner side walls with the rails between vertically adjacent pairs of the ribs until the recesses are aligned with corresponding tabs and then lowering the module to insert the tabs into the recesses.

In one form of the invention the bottom walls of the rails rest on the top walls of the corresponding ribs and the rear portions of the lower rails are sufficiently wide that those portions fit closely between adjacent ribs to restrain the front of the module from tipping down.

In another aspect of the invention the forward portion of the rib bottom walls slope upwardly toward the front of the side walls and the top walls of the lower rails slope downward toward the front of the module to assist insertion and removal of the module

DETAILED DESCRIPTION OF PREFERRED EMBODIMENT

Figures 1, 2, 3, 4:
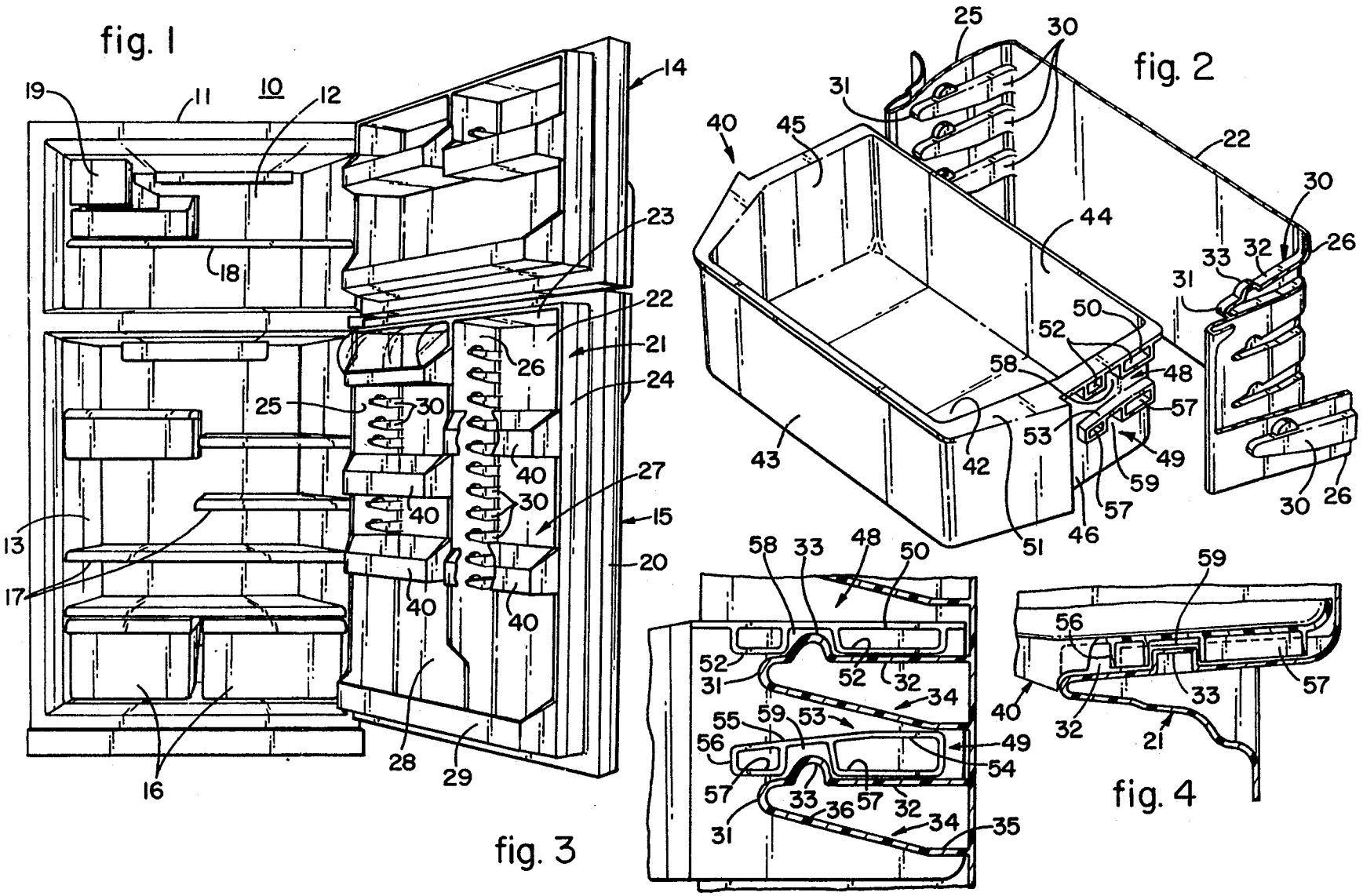
FIG. 1 is a simplified front view of a refrigerator of the type with the freezer above the fresh food compartment, with the doors open to show a door storage module assembly in accordance with one embodiment of the present invention.
FIG. 2 is a fragmentary, exploded view of a module and a portion of the fresh food compartment door liner of FIG. 1.
FIG. 3 is a fragmentary side elevational view of the module of FIG. 2, showing the relationship of the liner ribs and module rails when the module is fully assembled to the door liner.
FIG. 4 is a fragmentary cross sectional view further illustrating mating of the rails and ribs.

Referring now particularly to FIG. 1, there is shown a refrigerator 10 of the top mount type. That is the cabinet 11 encloses a freezer compartment 12 mounted or positioned above the fresh food compartment 13. The compartments include front access openings which normally are closed by hinged doors 14 and 15, respectively. Typically drawers 16 and shelves 17 are provided in the fresh food compartment to support various items to be refrigerated. The freezer may have a shelf 18 to enhance the storage capability and some models may include an automatic ice maker 19.

The fresh food compartment door 15 includes an outer shell or casing 20 and an inner liner 21. The space between them is filled a suitable insulation material, such as, for example, a body of foamed in place insulation. The gasket which extends around the periphery of the door to seal against air leakage when the door is closed has been omitted for the sake of simplicity.

The liner 21 includes a rear wall 22, a bottom wall (not shown), a top wall 23 , side walls 24, 25 and an intermediate wall 26. The intermediate wall 26 is parallel to the side walls 24, 25 and is spaced between them. The top, bottom, side and intermediate liner walls extend forward from the rear wall 22 to form recesses in the liner which face into and become part of the fresh food compartment 13 when the door 15 is closed. More particularly, the walls 24, 26, along with the other walls of the liner, define a first recess 27 while the walls 25, 26, along with the other walls of the liner, define a second recess 28. Thus each of the walls 24, 25 and 26 is a side wall of a recess. It will be understood that the fresh food compartment doors of some smaller size refrigerators and of many side-by-side refrigerators do not include an intermediate wall 26 and the door liner has only one recess.

Such door recesses often are utilized to store items which are not too bulky and particularly those items which are used frequently. In the illustrative door 15, a permanent shelf is mounted across the bottom of the door to store tall items. Spaced above the shelf 29, each of the side walls is provided with a series of vertically spaced apart ribs 30. As is best seen in FIG. 2, both sides of the intermediate side wall 26 are provided with ribs so that each side wall of each of the recesses 27, 28 has a series of ribs. The ribs on each side wall are aligned with the ribs on the facing side wall. While the ribs 30 are aligned across both recesses 27, 28, it will be understood that such alignment from one recess to the other is not necessary.

Each of the ribs 30 extends forward from the liner rear wall 22 and terminates in a distal end or tip 31. The top wall 32 of each rib is generally horizontal and includes an upwardly tab 33 proximate the distal end 31. Preferably the tabs are smoothly curved but with relatively steep sides adjacent their juncture with the main, horizontal portions of the corresponding walls 32. Each rib has a bottom wall 34 including a horizontal portion or section 35 adjacent the liner rear wall 22 and an upwardly inclined portion or section 36 extending between the horizontal section 35 and the tip 31. In this way, and as best seen in FIG. 3, the space between vertically adjacent pairs of ribs diverges toward the forward edges of the liner side walls and thus toward the open front of the recesses 27, 28.

A number of storage modules, illustrated by bins 40, are assembled to or mounted on the door liner by utilizing the ribs 30. Each of the modules 40 includes a bottom wall 42 a front wall 43, a rear wall 44 and a pair of side walls 45, 46. It will be understood that the bin modules 40 are illustrative only and the modules can take other shapes. For example they could have open backs to be more of a shelf construction and fit against the rear wall 22 of the liner or they could have just a band across the front to provide better visibility. However, whatever their shape, the modules are sized to fit the liner recesses 27, 28. That is, the width of the modules is such that, when a module is inserted into one of the recesses, the side walls 45, 46 of the module are closely adjacent to the side walls 24, 26 or 25, 26 of the recess.

Each module side wall is provided with an upper rail 48 and a lower rail 49. The rails extend from adjacent the rear edge of the module side walls 45, 46 toward the front of the module. Each upper rail is formed adjacent the top of the module and, in the illustrative modules the horizontal upper wall 50 is part of the rim around the upper edge of the module. The lower wall 52 of each upper rail 48 is also generally horizontal and is spaced relatively close to the upper wall 50 so that, when a module is assembled to the liner 21, the lower wall 52 will rest on the upper wall 32 of one liner rib 30 and the upper wall 50 of the upper rail 48 will be spaced below the horizontal portion 35 of the bottom wall 34 of the next higher rib 30. In this manner the upper surface or edge 51 of the modules will not become scarred and will present a pleasing appearance.

Each lower rail 49 includes a top wall 53 with a relative short horizontal portion or section 54 adjacent the rear of the module and a downwardly sloping portion or section 55 extending from the end of the horizontal portion 54 to the distal end 56 of the rail. Each lower rail also includes a generally horizontal bottom wall 57.

Each upper rail is formed with a downward opening recess 58 and each lower rail is formed with an aligned downward opening recess 59. A module is assembled to or mounted on a liner by inserting the module into one of the liner recesses 27, 28 with the rails 48, 49 being received between vertically adjacent pairs of ribs 30. When the tabs 33 are aligned with the recesses 58, 59 the module is lowered or tilted forward to insert the tabs into the recesses. The upward slope of the bottom wall portions 36 of the ribs 30 and the downward slope of the portions 55 of the lower rail top walls 53 provide ample clearance for the user to tilt the front of the module upward to clear the tabs 33 from the recesses 58, 59 for inserting and removing the module from the liner recess.

When fully assembled or mounted, the bottom walls 57 of the lower rails rest on the top walls 32 of a first pair of ribs 30 and the bottom walls 52 of the top rails 48 rest on the top walls 32 of the next higher pair of ribs 30. This provides a firm and stable support to the module while spreading the load on the liner to minimize the possibility of the weight of a module and its contents causing the liner to crack. The steep portions of the tabs 33 adjacent their intersection with the main horizontal portions of rib top walls 32 assures that vigorous opening and closing of the door will not dislodge the module from the tabs while, at the same time enhancing the ease with which a user may insert or remove a module.

The portion or section of each lower rail closest to the rear wall 22 of the liner, that is between horizontal top wall section 54 and bottom wall 57 fits closely between the top wall of one rib 30 and the bottom wall of the next higher rib 30, as seen in FIG. 3. If the front of a module tries to tip down over the front of the ribs 30, the resulting engagement of the lower rails with the upper ribs will prevent the module from falling or even coming loose.

For maximum flexibility the rails and ribs are spaced so that any three consecutive ribs form two contiguous pairs of ribs. That is the upper and middle ribs are a pair cooperating within the upper rail while the middle and lower ribs are a pair cooperating with the lower rail.

What is claimed is:

1. A refrigerator door storage module assembly including:

a refrigerator door having an outer shell and an inner liner including side walls and a rear wall defining a recess;

at least two pair of module supporting ribs projecting inwardly of each of said side walls and aligned with a corresponding pair of ribs projecting inwardly of said other side wall;

each of said ribs extending forward from said liner rear wall to a distal end and including top and bottom walls; said top wall being generally horizontal and including an upwardly projecting tab proximate its distal end; and said bottom wall having a relatively short horizontal portion adjacent said liner rear wall and an upwardly inclined portion extending between said relatively short horizontal portion and said rib distal end so that the facing top and bottom walls of vertically adjacent pairs of said module supporting ribs diverge toward their distal ends;

at least one door storage module receivable in the recess in said door liner, said module including a pair of spaced apart side walls positionable adjacent said door liner side walls;

a pair of rails projecting outward of each of said module side walls and extending from adjacent the rear edge of the corresponding module side wall toward the front of said module; each rail defining a downward opening recess;

whereby said at least one module is assembled to said door by sliding said module rails between adjacent pairs of said liner ribs until said recesses are aligned with corresponding tabs and then lowering said module to insert said tabs into said recesses.

2. A door module assembly as set forth in claim 1, wherein: the portion of selected ones of said rails adjacent the rear edge of said module fit closely between the horizontal portion of said bottom wall of a corresponding liner rib and the top wall of the next lower liner rib so that engagement between said selected rails and the bottom walls of said corresponding ribs restrains said module from tipping downwardly and falling out of the liner recess.

3. A door module assembly as set forth in claim 1, wherein: said liner side walls include a vertically arranged series of projecting ribs so that said at least one module can be mounted in any of a plurality of selected locations in the recess using different selected vertically adjacent pairs of ribs.

4. A door module assembly as set forth in claim 1, wherein: at least selected module rails have top walls with a relatively short horizontal portion adjacent the rear edge of the corresponding module side wall and a downwardly inclined portion extending between said relatively short horizontal portion of said selected module rails and the other end of that rail.

5. A door module assembly as set forth in claim 1, wherein: each pair of module rails includes an upper rail positioned adjacent the top of the corresponding module side wall and having horizontally disposed top and bottom walls spaced apart a distance such that, when said module is fully inserted into the liner recess, said upper rail bottom wall rests on the top wall of a selected liner rib and said upper rail top wall is spaced from the bottom wall of the next higher liner rib.

6. A door module assembly as set forth in claim 5, wherein: each pair of module rails also includes a lower rail spaced below said upper rail and having top and bottom walls spaced apart adjacent said rear edge of the corresponding module side wall a distance such that, when said module is fully inserted into the liner recess, said lower rail fits closely between the corresponding pair of liner ribs; said lower rail top wall having a relatively short horizontal portion adjacent said rear edge of the corresponding module side wall and a downwardly inclined portion extending between said relatively short horizontal portion of said lower rail top wall and the other end of said lower rail.

7. A refrigerator door storage module assembly including:

a refrigerator door having an outer shell and an inner liner including side walls and a rear wall defining a recess;

at least three module supporting ribs projecting inwardly of each of said side walls and aligned with corresponding ribs projecting inwardly of said other side wall;

each of said ribs extending forward from said liner rear wall to a distal end and including top and bottom walls; said top wall being generally horizontal and including an upwardly projecting tab proximate its distal end; and said bottom wall having a relatively short horizontal portion adjacent said liner rear wall and an upwardly inclined portion extending between said relatively short horizontal portion and said rib distal end so that the facing top and bottom walls of said vertically adjacent module supporting ribs diverge toward their distal ends;

at least one door storage module receivable in said door liner recess, said module including a pair of spaced apart side walls positionable adjacent said door liner side walls;

a pair of rails projecting outward of each of said module side walls and extending from adjacent the rear edge of the corresponding module side wall toward the front of said module; each rail defining a downward opening recess;

whereby said at least one module is assembled to said door by sliding said module rails between adjacent pairs of said liner ribs with said module rails received between vertically adjacent ones of said ribs until said recesses are aligned with corresponding tabs and then lowering said module to insert said tabs into said recesses.

8. A door module assembly as set forth in claim 7, wherein: the portion of selected ones of said rails adjacent the rear edge of said module fit closely between the horizontal portion of said bottom wall of a corresponding liner rib and the top wall of the next lower liner rib so that engagement between said selected rails and the bottom walls of said corresponding ribs restrains said module from tipping downwardly and falling out of the liner recess.

9. A door module assembly as set forth in claim 7, wherein: at least selected module rails have top walls with a relatively short horizontal portion adjacent the rear edge of the corresponding module side wall and a downwardly inclined portion extending between said relatively short horizontal portion of said selected module rails and the other end of that rail.

10. A door module assembly as set forth in claim 7, wherein: each pair of module rails includes an upper rail positioned adjacent the top of the corresponding module side wall and having horizontally disposed top and bottom walls spaced apart a distance such that, when said module is fully inserted into the liner recess, said upper rail bottom wall rests on the top wall of a selected liner rib and said upper rail top wall is spaced from the bottom wall of the next higher liner rib.

11. A door module assembly as set forth in claim 10, wherein: each pair of module rails also includes a lower rail spaced below said upper rail and having top and bottom walls spaced apart adjacent said rear edge of the corresponding module side wall a distance such that, when said module is fully inserted into the liner recess, said lower rail fits closely between the corresponding pair of liner ribs; said lower rail top wall having a relatively short horizontal portion adjacent said rear edge of the corresponding module side wall and a downwardly inclined portion extending between said relatively short horizontal portion of said lower rail top wall and the other end of said lower rail.

* * * * *